US005226249A

United States Patent [19]

Pippins

[11] Patent Number: 5,226,249

[45] Date of Patent: Jul. 13, 1993

[54] TIGHTLINE APPARATUS FOR DRAGLINES

[76] Inventor: Sherlock K. Pippins, 306 Rebecca Cir., Longview, Tex. 75601

[21] Appl. No.: 890,814

[22] Filed: Jun. 1, 1992

[51] Int. Cl.[5] ..... E02F 3/48; E02F 9/20

[52] U.S. Cl. ..... 37/116; 200/332; 212/149; 212/153; 212/167

[58] Field of Search ..... 340/685; 212/149, 152, 212/153, 159, 167; 200/332, 332.1, 335; 37/116, DIG. 1

[56] References Cited

U.S. PATENT DOCUMENTS 4,368,521 1/1983 Sholes ..... 37/DIG. 1 X
4,370,713 1/1983 McCoy, Jr. et al. ..... 212/153 X

FOREIGN PATENT DOCUMENTS 383795 8/1973 U.S.S.R. ..... 37/116
665062 5/1979 U.S.S.R. ..... 37/116

*Primary Examiner*—Dennis L. Taylor
*Assistant Examiner*—Arlen L. Olsen
*Attorney, Agent, or Firm*—John M. Harrison

[57] ABSTRACT

A tightline apparatus for draglines which includes a pair of mechanical safety devices, each having an engaging bar pivotally attached to a swivel frame of the dragline above each drag rope at the point where the respective drag rope extends between each set of guide rollers. A limit switch is also mounted on each fairlead frame in close proximity to the corresponding engaging bar, such that movement of the drag ropes upwardly responsive to swinging of the dragline bucket past a predetermined point toward the boom causes the drag ropes to engage the engaging bar element of each tightline apparatus and pivot the engaging bar into contact with the limit switches, respectively, to terminate operation of the dragline bucket.

20 Claims, 2 Drawing Sheets

TIGHTLINE APPARATUS FOR DRAGLINES

BACKGROUND OF THE INVENTION

1. Field of the Invention

This invention relates to draglines and more particularly, to a pair of tightline apparatus for mounting on the fairleads of the dragline in the path of the drag ropes, respectively, to facilitate termination of dragline operation in the event that the dragline bucket approaches the dragline boom past a predetermined close proximity. Each tightline apparatus includes a U-shaped engaging bar pivoted to a fairlead swivel frame of the dragline, such that the engaging bar is located above and in transverse alignment with one of the drag ropes extending from the upper vertical sheaves of the fairlead swivel frame to the bucket. In a preferred embodiment each engaging bar is spring-loaded in this position, such that movement of the drag ropes upwardly responsive to swinging of the dragline bucket inwardly toward the boom past a predetermined safety point causes the drag ropes to engage the respective engaging bars, pivot the engaging bars against the spring bias and activate a pair of limit switches, also mounted on the fairlead swivel frame. This action locks the brakes on the drag and hoist drum of the dragline and prevents dangerously close approach of the bucket to the dragline boom.

2. Description of the Prior Art

One of the problems which is inherent in the operation of draglines is that of inadvertently causing the dragline bucket to approach the boom past a predetermined distance, thereby placing dangerous stress on the boom. In some instances, dragline booms have been known to collapse under the stress created when the bucket is swung into critical close proximity to the boom, at great expense and extreme hazard to the workers. Accordingly, the dragline operator must exercise great care in pulling the bucket toward the dragline responsive to tension placed on the drag ropes, to insure that the bucket does not encroach on this predetermined critical distance from the boom. This distance may be inadvertently encroached upon under circumstances where the operator is not careful or where he is incapacitated by an accident such as a heart attack, stroke or other eventuality. Accordingly, there exists a need in the art for a device that will automatically terminate operation of the dragline under circumstances where this critical distance between the dragline bucket and boom is encroached upon.

It is an object of this invention to provide a tightline apparatus for mounting on a dragline and automatically terminating operation of the dragline under circumstances where the dragline bucket encroaches on a preselected critical distance with respect to the boom.

Another object of this invention is to provide at least one tightline apparatus which is designed to mount on the fairlead swivel frame of a dragline in alignment with at least one of the drag ropes for engagement with the drag rope under circumstances where the bucket is maneuvered within a predetermined critical distance from the dragline boom.

Yet another object of this invention is to provide a pair of new and improved tightline apparatus, each of which is characterized by an engaging bar pivotally mounted on a fairlead swivel frame of the dragline above and in transverse alignment with one of the drag ropes and a limit switch provided in each tightline apparatus in alignment with the corresponding engaging bar, such that upward movement of the drag ropes responsive to swinging of the dragline bucket into a predetermined unsafe distance between the dragline bucket and the boom causes the drag ropes to engage the corresponding engaging bars and pivot the engaging bars, thereby energizing the limit switches and locking the brakes on the drag and hoist drums of the dragline.

SUMMARY OF THE INVENTION

These and other objects of the invention are provided in a new and improved tightline apparatus for mounting on a dragline and limiting the approach of the bucket to the dragline, which tightline apparatus includes a pair of engaging bars pivotally attached to the respective bifurcated fairlead swivel frames of the dragline above and in transverse alignment with the respective drag ropes, and limit switches also mounted on the respective fairlead swivel frames in alignment with the corresponding engaging bars, such that upward movement of the drag ropes responsive to approach of the dragline bucket into a predetermined distance with respect to the dragline boom, causes the drag ropes to engage and pivot the engaging bars with respect to the fairlead swivel frames, activate the respective limit switches and lock the brakes on the drag and hoist drum, or otherwise deactivate the dragline, thereby preventing closer movement of the bucket to the boom.

BRIEF DESCRIPTION OF THE DRAWING

The invention will be better understood by reference to the accompanying drawings, wherein.

DESCRIPTION OF THE PREFERRED EMBODIMENTS

Figure 4:
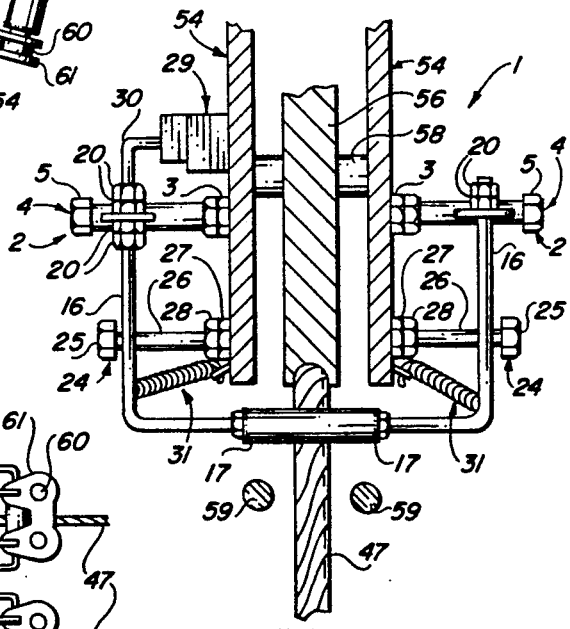
FIG. 4 is a sectional view taken along line 4-4 of the swivel frame illustrated in FIG. 2.
Figure 5:
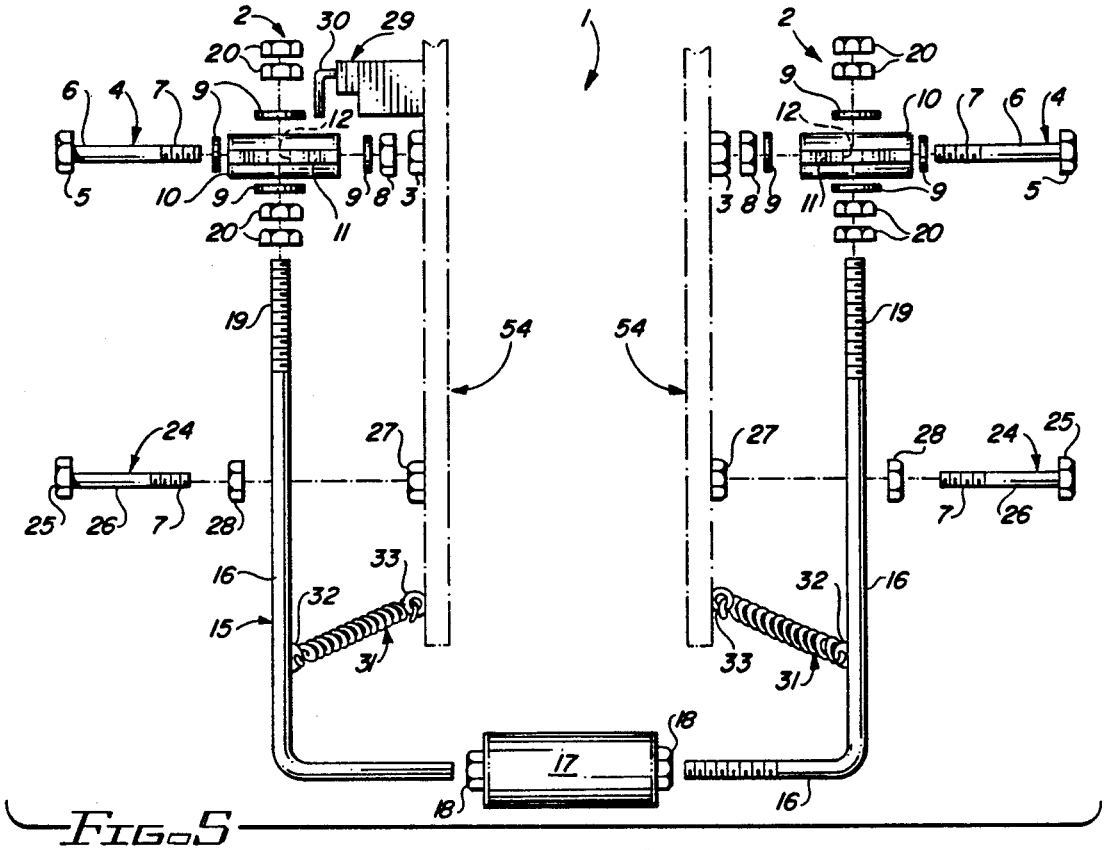
FIG. 5 is an exploded view of a preferred embodiment of the tightline apparatus of this invention.
Figure 6:
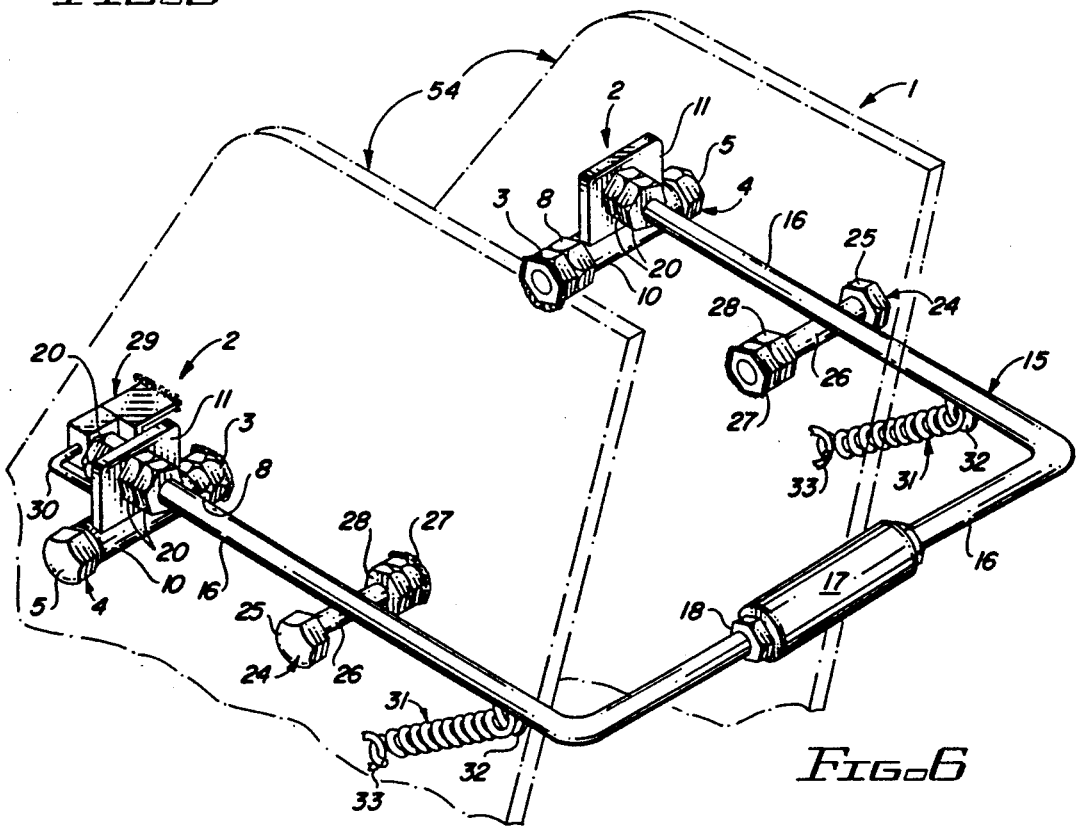
FIG. 6 is a perspective view of the tightline apparatus illustrated in FIG. 5, in functional configuration.

Referring initially to FIGS. 2–6 of the drawings, a preferred embodiment of the tightline apparatus of this invention is generally illustrated by reference numeral 1. The tightline apparatus 1 includes a pair of pivot bars 2, which are mounted on opposite plates of a pair of bifurcated swivel frames 54 of the fairlead 52 in a dragline 35, by means of base nuts 3, welded to the swivel frames 54, as illustrated in FIGS. 5 and 6. The shank threads 7 on the bolt shanks 6 of a pair of pivot bolts 4 each receive a pivot bolt nut 8 and engage a corresponding base nut 3 to facilitate tightening of each pivot bolt 4 in the corresponding base nut 3. A bolt sleeve 10 is mounted on the bolt shank 6 of each pivot bolt 4 between the bolt head 5 and the pivot bolt nut 8 and is provided with an internal bore which is slightly larger than the diameter of the bolt shank 6, to facilitate rotation of the respective bolt sleeves 10 with respect to the corresponding pivot bolts 4. In a most preferred embodiment of the invention a pair of washers 9 are fitted against the respective ends of the bolt sleeves 10, adjacent to the bolt head 5 on one end and the pivot bolt nut 8, respectively. A sleeve mount bracket 11 is also welded longitudinally to each bolt sleeve 10 and extends outwardly of each of the pivot bolts 4 and a bracket opening 12 is provided in each sleeve mount bracket 11, as further illustrated in FIG. 5.

The U-shaped bar leg 16 of an engaging bar 15 is positioned such that the extending ends of the bar leg 16, having leg threads 19, are projected through the bracket opening 12 in the sleeve mount brackets 11 of each of the pivot bars 2. Leg nuts 20 and washers 9 serve to secure the extending ends of the bar legs 16 to corresponding sleeve mount brackets 11, as further illustrated in FIG. 5. Accordingly, it will be appreciated from a consideration of FIG. 6, that when the engaging bar 15 is attached to the respective pivot bars 2, the engaging bar 15 may pivot with respect to the swivel frames 54 upon which the pivot bars 2 are mounted, as the respective bolt sleeves 10 and sleeve mount brackets 11 rotate in concert on the corresponding pivot bolts 4. A pair of bar stop bolts 24 are mounted on each of the bifurcated plates of the swivel frames 54 beneath the engaging bar 15, as further illustrated in FIGS. 5 and 6 and each bar stop bolt 24 includes a stop bolt head 25 and a threaded stop bolt shank 26, which is fitted with a stop bolt adjusting nut 28 and threadably extends into a corresponding stop bolt fixed nut 27, which is typically welded to a swivel frame 54. The bar stop bolts 24 serve to arrest the pivoting movement of the engaging bar 15 downwardly against the bias of a pair of coil springs 31, one end of each of which is attached to a bar eye bolt 32, secured to each leg of the engaging bar 15 and the other end to a frame eye bolt 33, welded or otherwise attached to the respective plates of the swivel frames 54, as further illustrated in FIGS. 5 and 6. As illustrated in FIGS. 5 and 6 a bar pad 17, constructed of rubber, plastic or a like resilient material, is provided with a pair of pad nuts 18, for receiving a threaded component of the bar leg 16. Alternatively, the bar pad 17 can be slotted and fitted to a continuous bar leg 16, as desired.

Referring again to FIGS. 5 and 6 of the drawings, a limit switch 29 is provided in close proximity to the outside leg nuts 20, mounted on one end of each bar leg 16 of the engaging bars 15 and is fitted with a switch trigger 30, provided in alignment with the outside leg nuts 20. The limit switch 29 is electrically connected to the electrical system (not illustrated) in the dragline 35 (illustrated in FIG. 1) which operates the brakes (not illustrated) on the drag and hoist drum (not illustrated) of the dragline 35.

Figure 1:
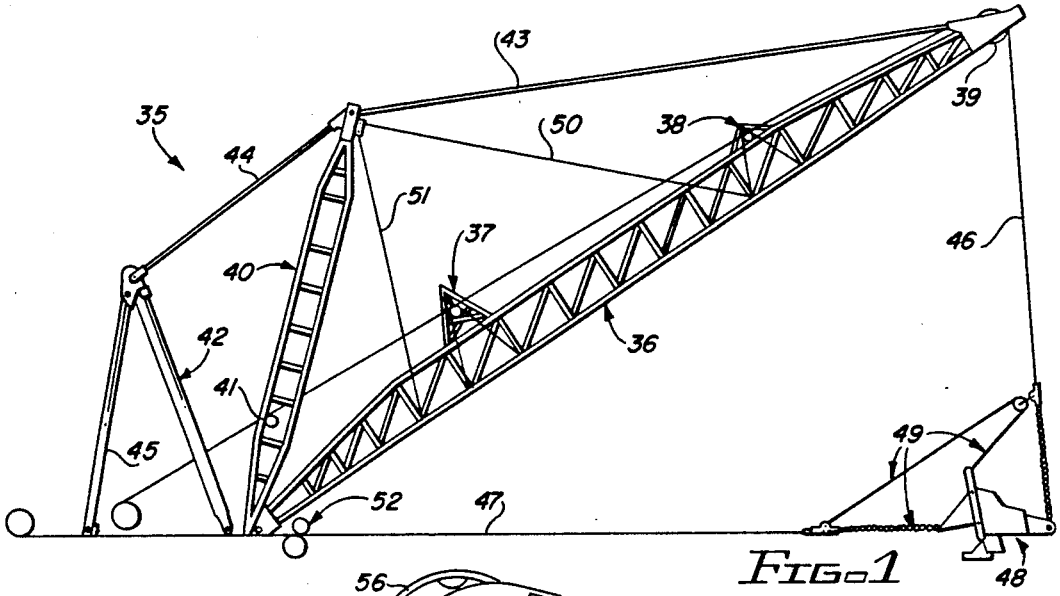
FIG. 1 is a side elevation of a conventional dragline.

Referring to FIG. 1 of the drawings, it will be appreciated by those skilled in the art that the tightline apparatus 1 of this invention is designed to be mounted in pairs on a conventional dragline 35, having a boom 36, fitted with a lower tower 37 and an upper tower 38, point sheaves 39 rotatably located at the extending end of the boom 36 and a mast 40, projecting from the bottom end of the boom 36. A rotatable deflection sheave 41 is mounted on the mast 40 and an A-frame 42 anchors a lower structural strand 44, extending between the top of the A-frame 42 and the top of the mast 40. An upper structural strand 43 projects from the top of the mast 40 to the extending end of the boom 36 and a safety structural strand 45 is provided in the A-frame 42. A hoist rope 46 extends from a bucket 48 around the point sheaves 39 for lifting the bucket 48 and a pair of drag ropes 47 also project from the bucket 48 to a fairlead 52, located at the base of the boom 36. Bucket rigging 49 is also connected to the bucket 48 for maintaining the bucket 48 in the proper orientation for digging purposes. An upper intermediate structural strand 50 and lower intermediate structural strand 51 also extend between the upper end of the mast 40 to various locations on the boom 36, for stabilizing the boom 36.

Figure 2:
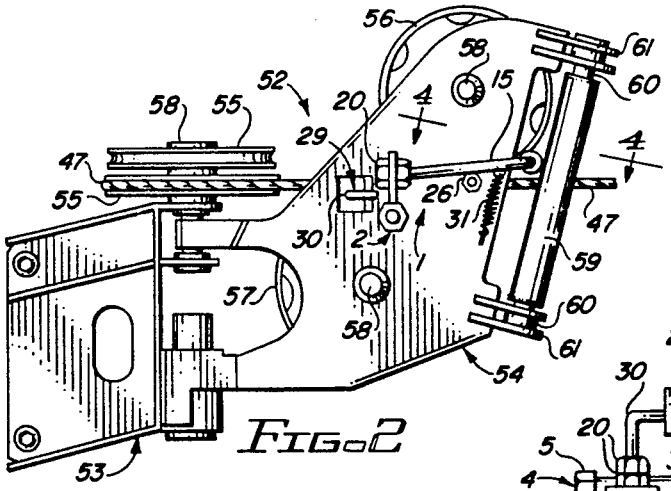
FIG. 2 is a side view of a fairlead frame and one set of swivel frames, with a preferred embodiment of the tightline apparatus mounted on the swivel frames in functional configuration.
Figure 3:
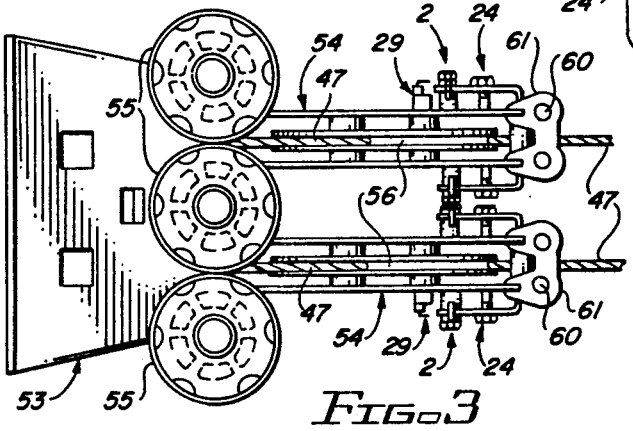
FIG. 3 is a top view of the fairlead frame and both sets of swivel frames, with a pair of tightline apparatus mounted on the swivel frames.

Referring now to FIGS. 2–4 of the drawings, the fairlead 52 in the dragline 35 is further characterized by a fairlead frame 53, fitted with a pair of bifurcated swivel frames 54, each fitted with a set of horizontal sheaves 55, upper vertical sheaves 56 and lower vertical sheaves 57, which are rotatably mounted in the swivel frames 54 by means of sheave pins 58, respectively. Vertical guide rollers 59 are provided in each of these swivel frames 54 and are also pivotally mounted by means of guide roller pins 60, on pin mount plates 61, as illustrated.

In operation, in a preferred embodiment of the invention and referring to FIGS. 2–6, a tightline apparatus 1 is installed on each of the tandem-mounted, bifurcated swivel frames 54 of the fairlead frame 53 of the dragline 35, such that the respective engaging bars 15 are pivotally attached to a corresponding pair of pivot bars 2, mounted on the spaced plates of the swivel frames 54, as described above. Each of the tightline apparatus further includes at least one bar stop bolt 24, two of which are illustrated, also mounted on the plates of the swivel frames 54, to prevent downward rotation of each engaging bar 15 with respect to the corresponding swivel frame 54. At least one coil spring 31, two of which are illustrated, is also secured to each side of each engaging bar 15 and to the respective plates of the swivel frames 54, as described above, to bias each respective engaging bar 15 downwardly against the corresponding bar stop bolts 24, with each of the bar pads 17 located above and in transverse alignment with a corresponding drag rope 47, extending from the respective upper vertical sheaves 56 and lower vertical sheaves 57 in the corresponding swivel frames 54. Accordingly, under normal operating circumstances where the bucket 48 operates a safe distance from the boom 36 in the dragline 35, the respective drag ropes 47 are spaced from the bar pads 17 of the engaging bars 15, respectively, and the dragline 35 is operated in conventional fashion. However, should an unforeseen event occur which allows the bucket 48 to move inwardly beyond a predetermined distance with respect to the boom 36, the drag ropes 47 swing upwardly with the inward motion of the bucket 48, contacting each engaging bar 15 and causing the engaging bars 15 to pivot upwardly in concert against the tension in the respective coil springs 31. This upwardly pivoting motion of the engaging bars 15 causes the outside leg nuts 20, mounted on the bar legs 16, to engage the corresponding switch triggers 30 of the limit switches 29 and electrically lock the brakes (not illustrated) on the drag and hoist drum (not illustrated) in the dragline 35, to prevent further motion of the bucket 48 toward the boom 36. When the bucket is then again swung outwardly of the boom 36, thereby lowering the drag ropes 47, the engaging bars 15 are allowed to return to their original positions against the respective bar stop bolts 24 responsive to the bias in the corresponding coil springs 31.

It will be appreciated by those skilled in the art that the respective limit switches 29 are connected electrically to conventional electrical components of the brake operating system (not illustrated) of the dragline 35, according to the knowledge of those skilled in the art. Accordingly, the inwardly-swinging function of the bucket 48 of the dragline 35 is limited, responsive to operation of the tightline apparatus 1 and limit switches 29, to stop any inadvertently close approach of the bucket 48 toward the boom 36 and thereby prevent overloading and damage to the boom 36.

It will be appreciated by those skilled in the art that while one or more of the illustrated tightline apparatus 1 are preferred for operation with the dragline 35, alterations may be made without affecting the function of the device. For example, instead of using a coil spring 31 to bias the engaging bars 15 against the respective bar stop bolts 24, a torsion spring (not illustrated) may be built into the pivot bolts 4 and bolt sleeve 10 of one or more of the pivot bars 2 to effect this biasing operation, as desired. Furthermore, motion-sensitive switches such as mercury switches may be mounted on the engaging bars 15 to electrically lock the brakes on the drag and hoist drum of the dragline 35 when the engaging bars 15 are pivoted to a selected angle by operation of the drag ropes 47.

Accordingly, while the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A tightline apparatus for engaging a drag rope of a dragline having a dragline bucket and preventing the dragline bucket from approaching a dragline boom closer than a predetermined distance, said tightline apparatus comprising:

engaging means having a pair of pivot bars fixedly carried by the dragline, a U-shaped engaging bar pivotally carried by said pivot bars, said engaging bar disposed in transverse alignment with the drag rope; and switch means operable to deactivate the dragline responsive to pivoting of said engaging means, whereby pivoting of said engaging means responsive to movement of the dragline bucket closer than said predetermined distance and engagement of said engaging means by the drag rope activates said switch means.

2. The tightline apparatus of claim 1 wherein said engaging means further comprises bias means operably connected to said engaging bar for biasing said engaging bar in a preselected position with respect to the drag rope.

3. The tightline apparatus of claim 2 wherein said bias means further comprises at least one spring having one end connected to said engaging bar and the other end of said spring carried by the dragline.

4. The tightline apparatus of claim 2 further comprising at least one stop means carried by the dragline and normally contacting said engaging bar responsive to the bias in said bias means.

5. The tightline apparatus of claim 2 wherein said bias means further comprises at least one coil spring having one end connected to said engaging bar and the other end of said coil spring carried by the dragline and further comprising at least one stop means carried by the dragline and normally contacting said engaging bar responsive to the bias in said coil spring.

6. The tightline apparatus of claim 1 wherein said switch means further comprises a limit switch having a trigger disposed in alignment with said engaging means, whereby pivotal engagement of said engaging means with said limit switch activates said limit switch.

7. The tightline apparatus of claim 6 wherein said engaging means further comprises bias means operably connected to said engaging bar for biasing said engaging bar in a preselected position with respect to the drag rope.

8. The tightline apparatus of claim 6 wherein said bias means further comprises a pair of coil springs, each having one end connected to said engaging bar in spaced relationship and the other end of said coil springs carried by the dragline.

9. The tightline apparatus of claim 6 wherein said engaging means further comprises at least one coil spring operably connected to said engaging bar for biasing said engaging bar in a preselected position with respect to the drag rope.

10. The tightline apparatus of claim 9 further comprising at least one stop means carried by the dragline and normally contacting said engaging bar responsive to the bias in said coil spring.

11. A tightline apparatus for engaging at least one drag rope of a dragline having a dragline bucket and preventing the dragline bucket from approaching a dragline boom closer than a predetermined distance, said tightline apparatus comprising a pair of pivot bolt means fixedly carried by the dragline; engaging bar means pivotally carried by said pivot bolt means, said engaging bar means disposed above and in substantially transverse alignment with the drag rope; bias means provided in operational engagement with said engaging bar means for normally biasing said engaging bar means into a predetermined position with respect to the drag rope; and switch means carried by the dragline in close proximity to said engaging bar means, whereby engagement of the drag rope with said engaging bar means and pivoting of said engaging bar means against the bias of said bias means causes said engaging bar means to contact said switch means and deactivate the dragline responsive to activation of said switch means.

12. The tightline apparatus of claim 11 further comprising at least one stop means carried by the dragline and normally contacting said engaging bar means responsive to the bias in said bias means.

13. The tightline apparatus of claim 11 wherein said bias means further comprises at least one coil spring having one end connected to said engaging bar means and the other end of said coil spring carried by the dragline.

14. The tightline apparatus of claim 11 wherein said bias means further comprises at least one coil spring having one end connected to said engaging bar means and the other end of said coil spring carried by the dragline and further comprising at least one stop means carried by the dragline and normally contacting said engaging bar means responsive to the bias in said coil spring.

15. The tightline apparatus of claim 11 wherein said switch means further comprises a limit switch having a trigger disposed in alignment with said engaging bar means, whereby engagement of said engaging bar means with said limit switch activates said limit switch.

16. The tightline apparatus of claim 11 wherein:

(a) said bias means further comprises a pair of coil springs each having one end connected to said engaging bar means in spaced relationship and the other end of said coil springs carried by the dragline; and (b) said switch means further comprises a limit switch having a trigger disposed in alignment with said engaging bar means, whereby engagement of said engaging bar means with said limit switch activates said limit switch, and further comprising at least one stop means carried by the dragline and normally contacting said engaging bar means responsive to the bias in said coil spring.

17. The tightline apparatus of claim 11 wherein said stop means further comprises a pair of stop bolts attached to at least one of the swivel frames.

18. The tightline apparatus of claim 11 wherein:

(a) said stop means further comprises a pair of stop bolts attached to the said at least one of the swivel frames; and (b) said bias means further comprises a pair of coil springs, each having one end connected to said engaging bar in spaced relationship and the other end of said coil spring carried by the dragline.

19. A tightline apparatus for engaging at least one drag rope of a dragline having a dragline bucket and a pair of swivel frames and preventing the dragline bucket from approaching a dragline boom closer than a predetermined distance, said tightline apparatus comprising a pair of pivot bolts mounted in fixed relationship on opposite sides of at least one of the swivel frames; a generally U-shaped engaging bar carried by said pivot bolts in pivoting relationship and positioned above and in substantially transverse alignment with the drag rope; at least one stop means fixedly attached to said at least one of the swivel frames in the path of pivot of said engaging bar for engaging said engaging bar and aligning said engaging bar in a predetermined position above and spaced from the drag rope; bias means engaging said engaging bar for normally biasing said engaging bar against said stop means; and switch means provided on said at least one of said swivel frames in the path of pivot of

20. The tightline apparatus of claim 19 wherein said bias means further comprises a pair of coil springs, each having one end connected to said engaging bar in spaced relationship and the other end of said coil springs carried by the dragline.

* * * * *